US006561590B2

(12) United States Patent
Sugden

(10) Patent No.: US 6,561,590 B2
(45) Date of Patent: May 13, 2003

(54) CUTTING DEVICE WITH ROTATING DISC

(75) Inventor: David Burnet Sugden, Kingston Beach (AU)

(73) Assignee: Odyssey Technology Pty Ltd, Brisbane (AU)

( * ) Notice: Subject to any disclaimer, the term of this patent is extended or adjusted under 35 U.S.C. 154(b) by 0 days.

(21) Appl. No.: 09/922,493

(22) Filed: Aug. 3, 2001

(65) Prior Publication Data

US 2002/0093239 A1 Jul. 18, 2002

Related U.S. Application Data

(63) Continuation of application No. PCT/AU00/00066, filed on Feb. 4, 2000.

(30) Foreign Application Priority Data

Feb. 4, 1999 (AU) ..... PP8465

(51) Int. Cl.[7] ..... E21C 25/16

(52) U.S. Cl. ..... 299/71; 299/78; 299/85.1; 83/647.5

(58) Field of Search ..... 299/37.1, 71, 78, 299/85.1, 80.1, 110, 106; 175/343, 55, 56; 125/3; 409/200; 83/647.5

(56) References Cited

U.S. PATENT DOCUMENTS

| | | | | | |
|---|---|---|---|---|---|
| 1,634,322 | A | * | 7/1927 | Dornes | 409/200 |
| 4,168,755 | A | * | 9/1979 | Willis | 175/215 |
| 4,169,629 | A | * | 10/1979 | Legrand | 299/31 |
| 4,245,939 | A | * | 1/1981 | Sear | 409/200 |
| 4,261,425 | A | * | 4/1981 | Bodine | 175/106 |
| 4,273,383 | A | * | 6/1981 | Grisebach | 299/23 |
| 4,372,403 | A | * | 2/1983 | Beeman | 175/343 |
| 4,417,379 | A | * | 11/1983 | Goode | 409/200 |
| 5,103,705 | A | | 4/1992 | Ulrich | 83/491 |
| 6,076,895 | A | * | 6/2000 | Ino et al. | 299/36.1 |

FOREIGN PATENT DOCUMENTS

| | | | |
|---|---|---|---|
| GB | 2136479 | 9/1984 | E21C/27/16 |
| SU | 581263 | 11/1977 | |
| SU | 714008 | 2/1980 | |
| SU | 1084438 | 4/1984 | |
| SU | 1263841 | 10/1986 | |
| WO | WO-00/46486 | 8/2000 | E21C/25/16 |

* cited by examiner

*Primary Examiner*—Heather Shackelford
*Assistant Examiner*—John Kreck
(74) *Attorney, Agent, or Firm*—Schwegman, Lundberg, Woessner & Kluth, P.A.

(57) ABSTRACT

A rock excavating or cutting device including a disc cutter that is driven by drive means to rotate in an oscillating and nutating manner by driving the disc cutter about separate oscillating and nutating axes aa, bb which are angularly offset from one another and which intersect at a point ahead of the disc cutter.

27 Claims, 5 Drawing Sheets

61
56
60
59
58
S
A
A
12

FIG. 4
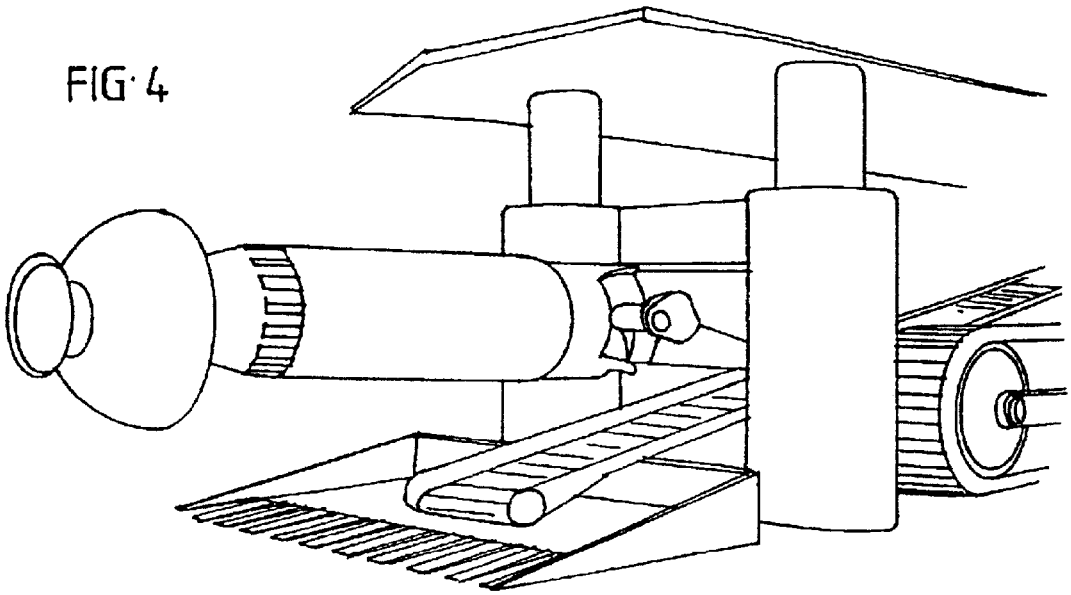
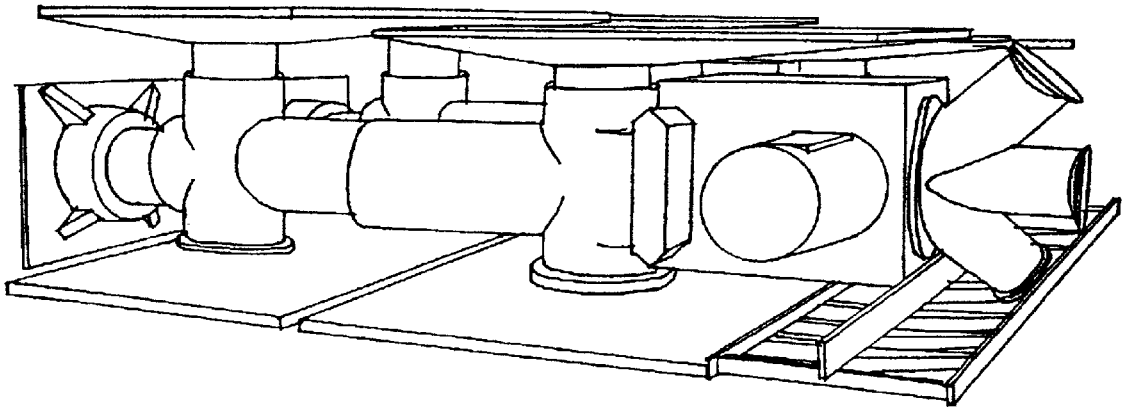
FIG 5

CUTTING DEVICE WITH ROTATING DISC

RELATED APPLICATIONS

This application is a Continuation Under 35 U.S.C. 120 of PCT/AU00/00066, filed Feb. 4, 2000, which claims priority under 35 U.S.C. 119 from Australian Patent Application No. PP 8465, filed Feb. 4, 1999, which applications are incorporated herein by reference.

FIELD OF THE INVENTION

The present invention relates to an earth cutting device for excavation purposes and is particularly, although not exclusively, concerned with excavating hard rock. It will be convenient therefore, to describe the invention in relation to that application, although it is to be appreciated that the invention could have wider application.

BACKGROUND OF THE INVENTION

Traditionally, excavation of hard rock in the mining and construction industries, has taken one of either two forms, namely explosive excavation, or rolling edge disc cutter excavation. Explosive mining entails drilling a pattern of holes of relatively small diameter into the rock being excavated, and loading those holes with explosives. The explosives are then detonated in a sequence designed to fragment the required volume of rock for subsequent removal by suitable loading and transport equipment. The explosives are detonated once all personnel are evacuated from the excavation site and the explosive process is repeated cyclically, until the required excavation is complete.

The use of explosives for excavation is known to be dangerous, while it is also environmentally unfriendly and results in damage to the country rock, with the result that clearing of loosened rock pieces and the erection of supports for the excavated surfaces is both dangerous and difficult. Additionally, the cyclical nature of the process and the violent nature of the rock fragmentation has to date, prevented automation of the explosive process, so that the modem requirement for continuous operation and increased production efficiency has not been met. Moreover, the relatively unpredictable size distribution of the rock product formed, complicates downstream processing.

Mechanical fragmentation of rock eliminating the use of explosives, has already been achieved and is well known through the use of rolling edge-type disc cutter technology. This technology has facilitated automation of the excavation process including the benefit of remotely controlled excavation machinery. However, rolling edge cutters require the application of very large forces in order to crush and fragment the rock under excavation. For example, the average force required per cutter is in the order of 50 tonnes and typically, peak forces experienced by each cutter are more than twice than this. It is common for multiple cutters to be arranged to traverse the rock in closely spaced parallel paths, and 50 cutters per cutting array is common. Cutting machinery of this kind can weigh upwards of 800 tonnes, thereby requiring electrical power in the order of thousands of kilowatts for operation. As such, that machinery can only be economically employed on large projects, such as water and power supply tunnels. Additionally, the excavation carried out by such machinery is limited to a cross-section which is circular.

SUMMARY OF THE INVENTION

It is an object of the invention to overcome, or at least alleviate one or more of the disadvantages associated with prior art cutting devices. It is a further object of the invention to provide a cutting device of a rotary cutting type, that provides improved rock removal from a rock face and which is relatively economical to manufacture and operate.

A rock excavating or cutting device according to the present invention includes a disc cutter, and is characterised in that the disc cutter is driven to move in an oscillating and nutating manner. The disc cutter is driven to move in this manner about separate oscillating and nutating axes, which are angularly offset from one another and intersect at a point ahead of the disc cutter. The magnitude of nutating movement is directly proportional to the angle of offset between the respective axes and generally that angle will be relatively small, such that the point of intersection between the axes is a relatively long way ahead of the disc cutter. In some arrangements, the point of intersection will approach infinity such that the amount of nutating movement is very small. Preferably, the disc cutter is caused to oscillate and nutate sinusoidally through a relatively small amplitude and at a very high frequency, such as about 3000 RPM.

The motion by which the disc cutter is driven, is such as to cause tensile failure of the rock, so that chips of rock are displaced from the rock surface under attack by the disc cutter. Here, the invention differs from rolling edge disc cutters, which apply force normal to the rock face to form lateral cracks that produce rock chips.

The force required to produce a tensile failure in the rock to displace a rock chip according to the device of the invention, is an order of magnitude less than that required by the known rolling edge disc cutters to remove the same amount of rock, so that the device of the invention is far more efficient in respect of energy requirements. Additionally, the device of the invention produces relatively little dust.

The device of the invention employs a reaction mass of sufficient magnitude to absorb the forces applied to the rock by the disc cutter during each cycle of oscillation and nutation, with minimum or minor displacement of the device, or the structure supporting the device. Because the device applies a load suitable to cause tensile failure of the rock, instead of crushing the rock, the force applied to the rock is substantially reduced, such that a corresponding reduction in the required reaction mass compared to known rock excavation machinery can also be adopted. The device of the invention as mounted to the support structure is preferably arranged that the reaction mass can absorb the cyclic and peak forces experienced by the disc cutter, while the support structure provides a restoring force relative to the average force experienced by the disc cutter.

The disc cutter of the cutting device preferably has a circular, rock engaging periphery, which is formed of a wear resistant material, such as hardened steel or tungsten carbide. Alternatively, the disc cutter can include a plurality of cutting tips, preferably of tungsten carbide, which are fixed to the circular rock engaging periphery thereof. Alternatively, the disc cutter can include a removable cutting disc that likewise is formed to have a circular rock engaging periphery of a wear resistant material, such as that described above.

The periphery of the disc cutter is arranged to be rotatable relative to the oscillating and nutating movement thereof, so that the periphery can roll against the rock surface under attack. In this manner, all parts of the cutting periphery edge are progressively moved out of contact with the rock and allowed to cool, and wear is evenly distributed. Because the contact force is relatively low, the wear rate is reduced compared to the rolling edge type of cutter.

The oscillating movement of the disc cutter can be generated in any suitable manner. In a preferred arrangement, the disc cutter is mounted for rotary movement on a drive shaft that includes a driven section which can be driven by suitable driving means and a mounting section on which the disc cutter is mounted. The axis about which the driven section rotates is angularly offset from the axis of the mounting section and in this arrangement, the disc cutter can move, as required, in a nutating manner simultaneously as it oscillates.

In a preferred arrangement, the disc cutter is mounted on one end of the shaft, which end comprises the mounting section and which extends from the shaft at an angle offset from the longitudinal axis of the shaft. The offset end may be formed integral with the shaft, or may be attached thereto and the end may include means to attach the disc cutter thereto. Those means allow for relative rotary movement, between the disc cutter and the mounting. The disc cutter may for example, be mounted on the mounting section by bearings, such as tapered roller bearings, to allow relative rotation therebetween.

The device of the invention can operate to cut or excavate very hard rock, with greatly reduced applied force and much higher output per disc cutter, while using less power per unit volume of rock removed. Thus the device can be mounted on a vehicle of significantly reduced weight and cost, compared, for example, to rolling edge disc cutters, while providing much greater flexibility in the geometry of excavation.

The cutting device of the invention is not restricted to a single disc cutter, but can include more than one. For example, the cutting device may include three disc cutters arranged along the same plane, but angled at approximately 45° to each other. Such an arrangement can produce a cut face of a particular shape, while the speed at which rock is removed is greatly increased. In this arrangement, each of the three disc cutters can be driven by the one drive means, or they may be driven by separate drive means. The use of multiple disc cutters is particularly useful for long wall operations.

The device of the invention typically requires substantially reduced applied forces relative to known rock excavating machinery. A reduction at least in respect of normal forces, in the order of one tenth is envisaged. Such low forces facilitates the use of a support structure in the form of an arm or boom, which can force the edge of the disc cutter into contact with the rock at any required angle and to manipulate the position of the disc cutter In any direction. In particular, in relation to long wall mining, the disc cutter, or array of disc cutters, may be mounted to traverse the length of the long wall face and to be advanced at each pass. Advantageously, the invention provides for entry of the disc cutter into the rock face from either a previously excavated drive in a long wall excavation, or from pre-bored access holes, or by attacking the rock at a shallow angle to the face until the required depth for the pass is achieved. With the disc cutter mounted on a movable boom, the disc cutter can be moved about the rock face to excavate that face at any desired geometry.

In still a further arrangement, a pair of disc cutters may be mounted on separate booms and the disc cutters are swept in an arc across the rock face, continually removing successive layers of rock from the face, and forming a cusp between adjacent concave sections. The cusp provides an entry point for the disc cutter on the return pass thereof.

The cutting device of the invention is suitable for a range of cutting and mining operations and machinery, such long wall mining, mobile mining machines, tunnelling machines, raise borers, shaft sinkers and hard rock excavation generally.

BRIEF DESCRIPTION OF THE DRAWINGS

The attached drawings show an example embodiment of the invention of the foregoing kind. The particularity of those drawings and the associated description does not supersede the generality of the preceding broad description of the invention.

FIG. 4 shows a further embodiment of the invention mounted on a boom.

FIG. 5 shows a further embodiment of the invention.

DETAILED DESCRIPTION

Figure 1:
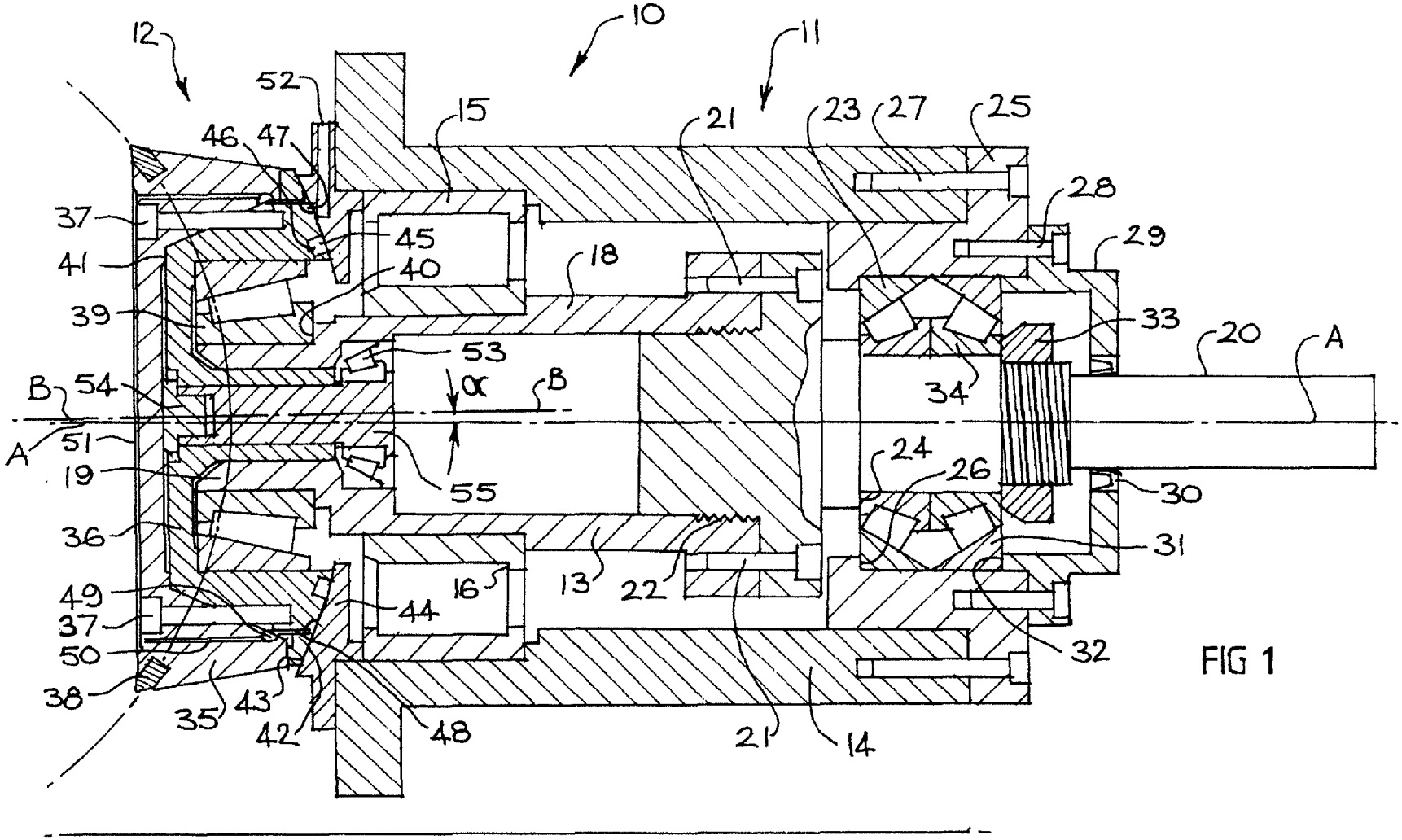
FIG. 1 shows a part cross-sectional view of a cutting device according to the invention.

FIG. 1 is a cross-sectional view of a cutting device according to the invention. The cutting device 10 includes a mounting assembly 11 and a rotary disc cutter 12. The mounting assembly 11 includes a mounting shaft 13 which is rotatably mounted within a housing 14, that can constitute or be connected to a large mass for impact absorption. The housing 14 thus, can be formed of heavy metal or can be connected to a heavy metallic mass. The shaft 13 is mounted within the housing 14 by a bearing 15, which can be of any suitable type and capacity. The bearing 15 is mounted in any suitable manner known to a person skilled in the art, such as against a stepped section 16.

Figure 2:
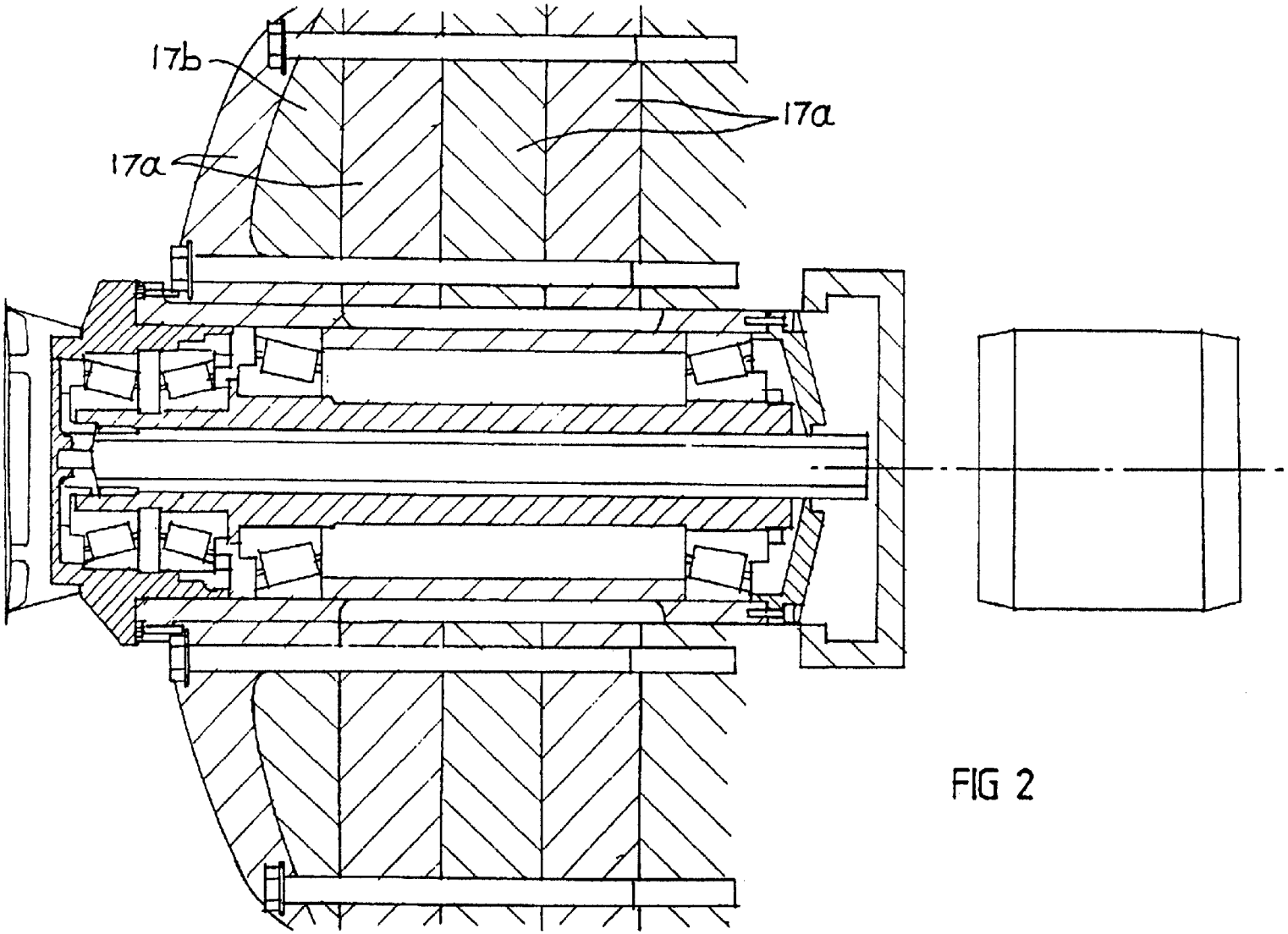
FIG. 2 is an enlarged view of the cutting device of FIG. 1.

The housing 14 can have any suitable construction, and in one form includes a plurality of metal plates fixed together longitudinally of the shaft 13. Such an arrangement is shown in FIG. 2, and with this arrangement, applicant has found that a plurality of iron plates 17*a* and a single lead plate 17*b* provides effective impact absorption based on weight and cost considerations.

The shaft 13 is mounted for rotating motion about a central longitudinal axis AA. The shaft 13 includes a driven section 18 and a mounting section 19. The driven section 18 is connected to drive means 20 at the end thereof remote from the mounting section by any suitable connectors, such as heavy duty threaded fasteners 21, while a seal 22 is applied between the facing surfaces of the mounting section and the drive means.

The drive means 20 can take any suitable form and the means shown in FIG. 1 is a shaft that may be driven by a suitable engine or motor. The drive means 20 is mounted within the housing 14 by bearings 23, which are tapered roller bearings, although other types of bearings could also be employed. The bearings 23 are mounted against a stepped section 24 of the drive means 20 and against a mount insert 25 which is also stepped at 26. The mount insert 25 is fixed by threaded connectors 27 to the housing 14 and fixed to the mount insert 25 by further threaded connectors 28 is a sealing cap 29 which seals against the drive means 20 by seals 30. The sealing cap 29 also locates the outer race 31 of the bearings 23 by engagement therewith at 32, while a threaded ring 33 locates the inner race 34.

The mounting section 19 is provided for mounting of the disc cutter 12 and is angularly offset from the axis AA of the driven section 18, which generally will be approximately normal to the rock face being excavated. The axis BB of the mounting section 19 is shown in FIG. 1 and it can be seen that the offset angle $\alpha$ is in the order of a few degrees only. The magnitude of the offset angle $\alpha$ determines the size of the oscillating and nutating movement of the disc cutter 12 and the angle $\alpha$ can be arranged as appropriate.

The disc cutter 12 includes an outer cutting disc 35 that is mounted on a mounting head 36 by suitable connecting means, such as threaded connectors 37. The outer cutting disc 35 includes a plurality of tungsten carbide cutting bits 38 which are fitted to the cutting disc in any suitable manner. Alternatively, a tungsten carbide ring could be employed. The outer cutting disc can be removed from the cutting device for replacement or reconditioning, by removing the connectors 37.

The disc cutter 12 is rotatably mounted on the mounting section 19 of the mounting shaft 13. The disc cutter 12 is mounted by a tapered roller bearing 39, that is located by a step 40 and a wall 41 of the mounting head 36. An inclined surface 42 of the mounting head 36 is disposed closely adjacent a surface 43 of a mounting insert 44. The surfaces 42 and 43 are spaced apart with minimum clearance to allow relative rotating movement therebetween and the surfaces have a spherical curvature, the centre of which is at the intersection of the axes AA and BB.

A seal 45 is located in a recess 46 of the surface 42 to seal against leakage of lubricating fluid from between the mounting shaft 13, and the housing 14 and the disc cutter 12. A channel 47 is also provided in the surface 42 outwardly of the seal 45 and ducts 48 connect the channel 47 to a further channel 49 and a further duct 50 extends from the channel 49 to the front surface 51 of the outer cutting disc 35. Pressurised fluid can be injected into the various channels and ducts through the port 52 and that fluid is used to flush the underside of the cutting disc 35 as well as the relative sliding surfaces 42 and 43.

The disc cutter 12 is rotatably mounted to the mounting section 19 of the mounting shaft 13 by the tapered roller bearing 39 and by a further tapered roller bearing 53. The bearing 53 is far smaller than the bearing 39 for the reason that the large bearing 39 is aligned directly in the load path of the disc cutter and thus is subject to the majority of the cutter load. The smaller bearing 53 is provided to pre-load the bearing 39.

The bearing 52 is mounted against the inner surface of the mounting shaft 13 and the outer surface of a bearing loading facility, comprising a nut 54 and a pre-loading shaft 55. Removal of the outer-cutting disc 35 provides access to the nut 54 for adjusting the pre-load of the bearing 53.

Figure 3:
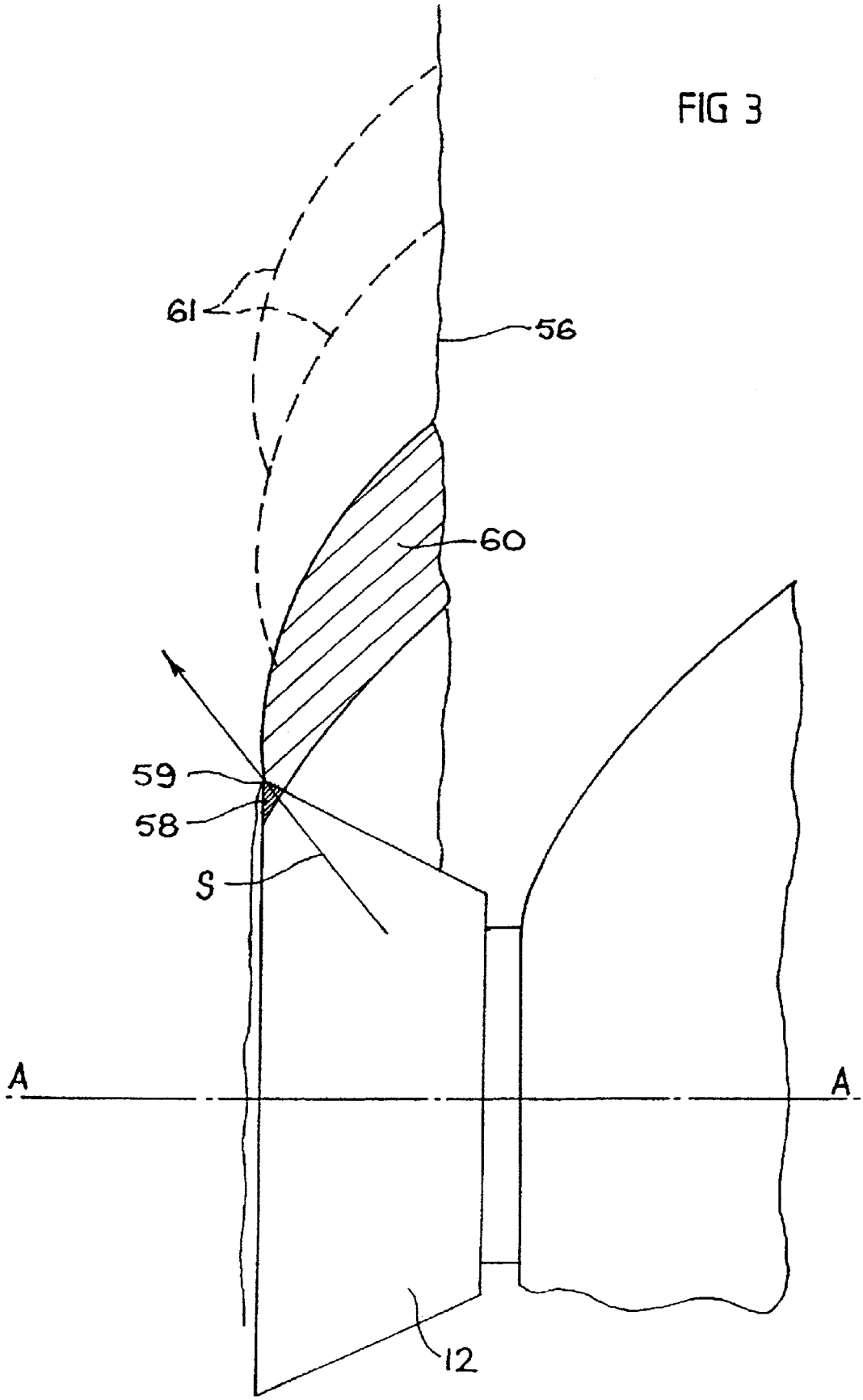
FIG. 3 is a schematic view of the action of the cutting device in excavating a rock face.

The nutating movement of the disc cutter 12, occurs simultaneously with the oscillating motion and that nutating movement is movement in which a point on the cutting edge of the disc cutter is caused to move sinusoidally, in a cyclic or continuous manner as the disc cutter rotates. This movement of the disc cutter applies an impact load to the rock surface under attack, that causes tensile failure of the rock. With reference to FIG. 3, it can be seen that the motion of the disc cutter 12 brings the cutting tip or edge 58 into engagement under the oscillating movement at point 59 of the rock 56 Such oscillating movement results in travel of the disc cutter 12 in a direction substantially perpendicular to the axis AA. The provision of simultaneous nutating movement causes the cutting edge 58 to strike the face 59 substantially in the direction S, so that a rock chip 60 is formed in the rock as shown. Future chips are defined by the dotted lines 61. The action of the disc cutter 12 against the under face 59 is similar to that of a chisel in developing tensile stresses in a brittle material, such as rock, which is caused effectively to fail in tension.

The direction S of impact of the disc cutter against the rock under face 59 is reacted through the bearing 39 and the direction of the reaction force is substantially along a line extending through the bearing 39 and the smaller bearing 53.

In a cutting device according to the invention, the mass of the disc cutter is relatively much smaller than the mass provided for load absorption purposes. The load exerted on the disc cutter when it engages a rock surface under the oscillating/nutating movement, is reacted by the inertia of the large mass, rather than by the support structure.

The cutting device of the invention is preferably mounted for movement into the rock being excavated. Thus, the device can be mounted for example, on wheels or rails and it is preferred that the mounting facility be arranged to react the approximate average forces applied by the disc cutter, while the large absorption mass reacts the peak forces.

The various bearings employed in the invention can be of any suitable kind, but preferably they are anti-friction roller bearings, and can be hydrodynamic or hydrostatic bearings.

The present invention can be applied to a wide variety of cutting devices and one such device is shown in FIG. 4. In this figure, the cutting device is pivoted on a boom so that he disc cutter can be manoeuvred about the boom pivot point to excavate a rock face.

FIG. 5 shows a different arrangement in which three disc cutters extend from the cutting device and these cutters are aligned along the same plane and are oriented at an angle to each other, the angle being approximately 45°. Each of the disc cutters is arranged for oscillating and nutating movement as previously described.

Figure 6:
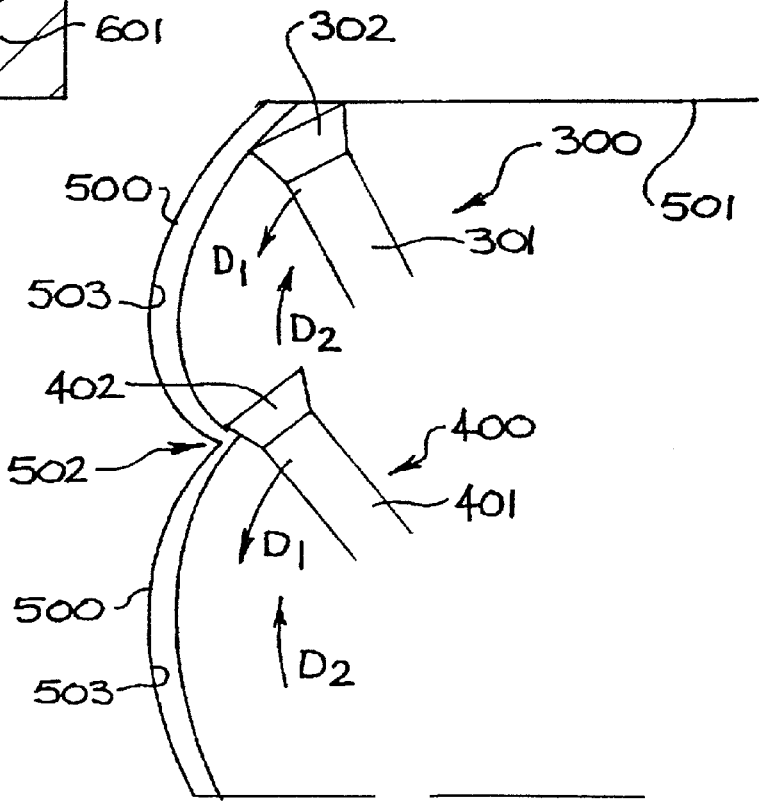
FIG. 6 shows the application of the invention to sweep excavations.

FIG. 6 shows an arrangement of two cutting devices 300 and 400 which pivotally arranged on respective booms 301 and 401 (such as that shown in FIG. 4), and in which the disc cutter 302 and 402 of each device is arranged to sweep in an arc across the rock face 500 being excavated in a first direction $D_1$ and having completed that sweep, return in the reverse direction $D_2$, with each sweep of the disc cutters removing a layer of the rock face 500. Entrance of the disc cutters into the rock for each successive pass, may be at the cusp 502 between adjacent concave sections 503 formed by the sweep of each disc cutter. This method provides a bore 501 as shown.

Figure 7:
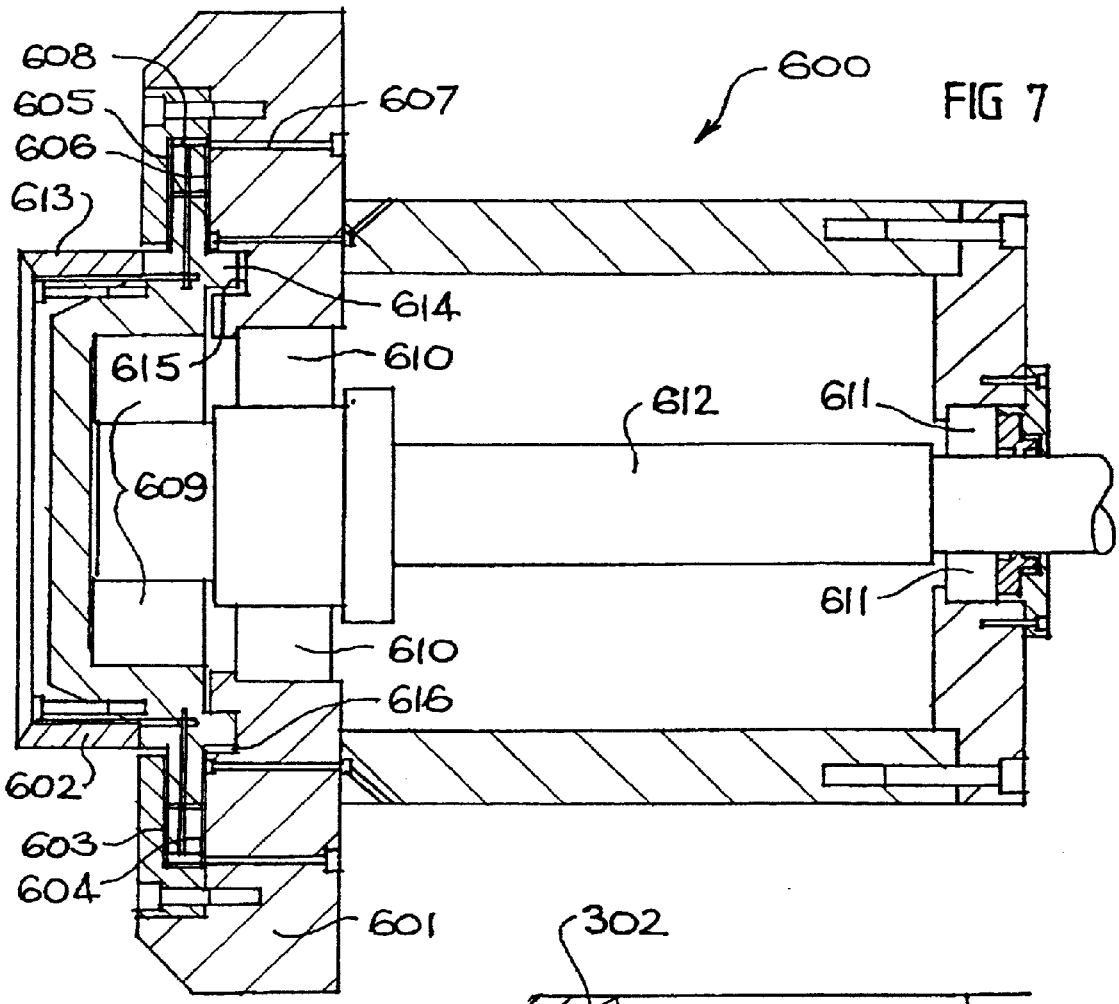
FIG. 7 shows an alternative embodiment of the invention.

FIG. 7 shows a further alternative arrangement of the present invention, which has generally the same operating characteristics as the cutting device of FIG. 1. Therefore, the description relating to FIG. 7 will relate to areas of difference only.

In FIG. 7, the cutting device 600 includes a bearing arrangement between the mounting plate 601 and the cutting disc 602, and specifically between an annular flange 603 of the cutting disc and the internal walls of an annular slot 604 formed in the mounting plate.

The bearing arrangement of FIG. 7 includes annular bearings 605 and 606 which, in the embodiment illustrated, are anti-friction, water lubricated bearings. Water lubrication is provided through a conduit 607 that communicates with an annular space 608 to distribute lubricating water to each of the bearings 605, 606.

The bearings 605, 606 are provided to bear axial thrust loading, so that the remaining bearings of the cutting device 600 are subject only to radial loading. The arrangements described earlier, such as that of FIG. 1, employ tapered roller bearings to accommodate axial thrust loading but in the FIG. 7 embodiment, non-tapered roller bearings can generally be employed instead. See for example the bearings 609, 610 of FIG. 7. This arrangement is considered to have superior performance compared to the earlier described arrangements, as the tapered roller bearings employed in those arrangements lacked the ability to completely bear the thrust loadings that the device 600 will experience. Tapered roller bearings may still be employed if considered desirable and thus bearings 611 are of the tapered roller bearing kind. The annular bearings 605, 606 can be of any suitable shape and conveniently, the shape of those bearings can be such as to facilitate the nutating movement of the cutting disc 602.

A further feature of the FIG. 7 arrangement is the use of cutting disc drive means between the cutting disc 602 and the mounting plate 601. That drive means is operable to drive the cutting disc 602 in the reverse direction compared to the direction of rotation of the drive shaft 612. Reverse rotation of the cutting disc 602 is desirable to minimise or eliminate relative movement between the cutting edge 613 of the cutting disc 602, and the rock face when the cutting edge 613 engages the rock face. Reverse rotation preferably causes the cutting edge 613 to roll against the rock face. As such, wear of the cutting edge is limited to that produced by the impact of the edge engaging the rock face, and little or no wear is experienced through frictional drag or scraping movement between the edge 613 and the rock face.

The drive means discussed above can comprise a gear arrangement and in FIG. 7, that may be provided between the mounting plate 601 and the cutting disc 602 on the ring 614 that is accommodated within the slot 615. The gear arrangement 616 operates so that rotation of the mounting plate 601 by the drive shaft 612 drives the cutting disc 602 in the reverse direction. It will be appreciated that the mounting plate 601 is not directly driven by the drive shaft 612, but that rotation of the mounting plate 601 occurs by virtue of drag through the various bearings 609, 610 and 611. That drag will eventually cause the mounting plate 601 to rotate at or about the same speed as the drive shaft 612, nominally about 3000 RPM, in the absence of any load applied in the reverse direction. In the same manner, in the absence of drive means to drive the cutting disc 602 in the reverse direction and in the absence of other loads, particularly loads resulting from engagement of the cutting edge 613 with the rock face, the disc 602 will likewise be driven at or about the same speed as the drive shaft. Thus, in those circumstances, when the cutting edge 613 of the rotating cutting disc 602 engages the stationary rock face, it experiences a substantial drag load tending to slow the rotation of the disc. In practice, the cutting disc can be slowed, almost instantaneously, from about 3000 RPM to about 40 RPM, with significant wear or damage resulting to the cutting edge 613. By employing drive means to drive the cutting disc in the reverse direction, that wear or damage can be largely reduced or eliminated.

In order to minimise or eliminate drag of the cutting edge 613 against the rock face as described above, the pitch circle diameter of the gear arrangement 616 should be the same as the diameter of the cutting edge 613.

The gear arrangement 616 described above is not the only arrangement by which reverse rotation of the cutting disc 602 can be achieved. Other arrangements could equally apply and therefore, the invention is not restricted to the arrangement described. It is also to be appreciated that the drive means described in relation to FIG. 7 could equally be embodied in other arrangements according to the invention.

The cutting device of the present invention is considered to provide more cost efficient rock cutting, because the device can be built at a fraction of the weight of known rotary cutting machinery. It is envisaged that the cutting device of the invention including the support arm, can be manufactured to have a total weight of approximately 20 tonne. This means that the device will be far cheaper to manufacture and run compared to the known rotary cutting machinery. The weight reduction is principally due to the enhanced rock cutting which results from the combination of oscillating and nutating movement of the disc cutter. Thus, the rock cutting device is subject to reduced impact loading and therefore requires substantially less facility for impact absorption. Additionally, the shocks produced by the cutting process are relatively minor and thus these cause negligible damage to the country rock, and thus lessen the likelihood of rock falls and reduce amount of support necessary for excavated surfaces. Moreover, because of the overall weight of the device and the magnitude of the shocks produced, the device can be mounted on a vehicle for movement into the excavated surface.

The invention described herein is susceptible to variations, modifications and/or additions other than those specifically described and it is to be understood that the invention includes all such variations, modifications and/or additions which fall within the spirit and scope of the above description.

What is claimed is:

1. A rock excavating or cutting device, including a disc cutter adapted to be driven by drive means to rotate in an oscillating and nutating manner by driving said disc cutter about separate oscillating and nutating axes which are angularly offset from one another and which intersect at a point ahead of said disc cutter.

2. A rock excavating or cutting device according to claim 1, said disc cutter being driven to oscillate and nutate sinusoidally through a small amplitude and at a high frequency.

3. A rock excavating or cutting device according to claim 2, said disc cutter being driven at approximately 3000 RPM.

4. A rock excavating or cutting device according to claim 1, said device including a reaction mass for absorption of peak and cyclic forces experienced by said disc cutter and a support structure on which said device including said reaction mass is mounted and which provides a restoring force relative to the average force experienced by the disc cutter during excavation.

5. A rock excavating or cutting device according to claim 1, said disc cutter having a circular rock engaging periphery which is formed of a wear resistant material.

6. A rock excavating or cutting device according to claim 5, said disc cutter including a plurality of cutting tips which are fixed to said circular rock engaging periphery.

7. A rock excavating or cutting device according to claim 6, wherein the plurality of cutting tips comprise tungsten carbide.

8. A rock excavating or cutting device according to claim 5, said circular rock engaging periphery of said disc cutter being removable.

9. A rock excavating or cutting device according to claim 5, wherein the circular rock engaging periphery of said disc cutter is rotatable in addition to and relative to the respective oscillating and nutating movement in which said disc cutter is driven, to permit said circular rock engaging periphery to roll against the rock surface being excavated.

10. A rock excavating or cutting device according to claim 9, said disc cutter being driven by drive means to roll against the rock surface being excavated.

11. A rock excavating or cutting device according to claim 10, said disc cutter being mounted relative to a mounting plate and each of said disc cutter and said mounting plate being mounted on a drive shaft to drive said disc cutter in an oscillating and nutating manner, further drive means being employed between said disc cutter and said mounting plate to drive said disc cutter to rotate in the reverse direction to the direction of rotation of said drive shaft.

12. A rock excavating or cutting device according to claim 11, said disc cutter and said mounting plate being mounted on said drive shaft by respective roller bearings.

13. A rock excavating or cutting device according to claim 11, said disc cutter and said mounting plate being engaged through an annular flange and slot arrangement, annular bearings being provided between the facing axial surfaces of the said flange and slot arrangement to bear axial thrust loads.

14. The rock excavating or cutting device according to claim 5, wherein the wear resistant material comprises hardened steel or tungsten carbide.

15. A rock excavating or cutting device according to claim 1, said disc cutter including an outer cutting disc removably mounted on a head.

16. A rock excavating or cutting device according to claim 1, said drive means including a drive shaft having a driving section which is driven by driving means, and a mounting section for mounting said disc cutter, the axis about which said driving section is rotated by said driving means being offset angularly from the axis of said mounting section.

17. A rock excavating or cutting device according to claim 16, said disc cutter being mounted on said mounting section by bearings that permit said disc cutter to rotate relative to said mounting section.

18. A rock excavating or cutting device according to claim 1, including a plurality of disc cutters, each arranged to be driven by drive means about separate oscillating and nutating axes which are angularly offset from one another and intersect at a point ahead of said disc cutter.

19. A rock excavating or cutting device according to claims 18, said device including three said disc cutters arranged along the same plane angled at approximately 45° to each other.

20. A rock excavating or cutting device according to claim 1, said disc cutter being mounted on an arm or boom that permits the cutting edge of the disc cutter to be brought into contact with the rock being excavated at a variety of angles.

21. A cutting device comprising:

a disc cutter;

an oscillating axis;

a nutating axis, wherein the oscillating and nutating axis are angularly offset from each other such that the oscillating and nutating axis intersect at a point ahead of the disc cutter; and drive means for driving the disc cutter about both the oscillating axis and the nutating axis.

22. A cutting device according to claim 21, wherein the means for driving is adapted to drive the disc cutter at least about 40 RPM.

23. A cutting device according to claim 21, wherein the means for driving is adapted to drive the disc cutter at least about 500 RPM.

24. A cutting device according to claim 21, wherein the means for driving is adapted to drive the disc cutter at least about 1000 RPM.

25. A cutting device according to claim 21, wherein the means for driving is adapted to drive the disc cutter at least about 1500 RPM.

26. A cutting device according to claim 21, wherein the means for driving is adapted to drive the disc cutter at least about 2000 RPM.

27. A cutting device according to claim 21, wherein the means for driving is adapted to drive the disc cutter at least about 2500 RPM.

* * * * *